United States Patent [19]

Mania et al.

[11] 3,939,526

[45] Feb. 24, 1976

[54] CLEANING DEVICE FOR FLANGED REELS

[75] Inventors: Max Joachim Mania, Eckartsweier; Albrecht Weidmann, Offenburg, both of Germany

[73] Assignee: BASF Aktiengesellschaft, Ludwigshafen (Rhine), Germany

[22] Filed: July 30, 1974

[21] Appl. No.: 493,055

[30] Foreign Application Priority Data

Aug. 1, 1973 Germany ..... 2338939

[52] U.S. Cl. ..... 15/306 B; 15/1.5 R; 15/345

[51] Int. Cl.[2] ..... A47L 5/38

[58] Field of Search ..... 15/303, 306 B, 306 R, 345, 15/346, 306 A, 308, 1.5

[56] References Cited

UNITED STATES PATENTS

| | | | |
|---|---|---|---|
| 2,413,937 | 1/1947 | Zademach et al. | 15/306 B X |
| 3,668,008 | 6/1972 | Severynse | 15/1.5 X |

*Primary Examiner*—Harvey C. Hornsby
*Assistant Examiner*—C. K. Moore
*Attorney, Agent, or Firm*—Johnston, Keil, Thompson & Shurtleff

[57] ABSTRACT

A device for cleaning the surfaces of a moving flanged reel consists essentially of an assembly of nozzles which are provided with electrical discharge means and direct charged gas onto the reel and are arranged adjacent to the path along which the reel is transported, and a suction device for withdrawing the particles, etc. removed from the reel. Other embodiments of the invention concern the positioning of the nozzles, the arrangement of the suction device, the positioning of the reel during the cleaning process and an advantageous device for conveying a plurality of reels to be cleaned one after the other.

The cleaning device of the invention can be used to clean flanged reels of all types on which strip materials susceptible to dust such as photographic film and magnetic tape, especially magnetic tape for date and video recording, are to be wound.

7 Claims, 4 Drawing Figures

CLEANING DEVICE FOR FLANGED REELS

Figure 1:
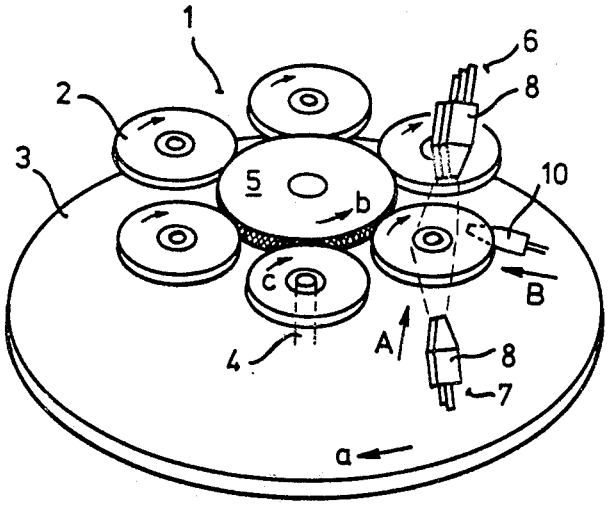

This application discloses and claims subject matter described in German patent application P 23 38 939.1, filed Aug. 1, 1973, which is incorporated herein by reference.

This invention relates to a device for cleaning the surfaces of moving reels, especially magnetic tape reels.

A known method of preventing thin strip material, especially magnetic tape, from being deformed due to the presence of foreign bodies such as dirt and dust particles consists in thoroughly cleaning the reels by hand, prior to winding, using, for example, a damp absorbent foam cloth or chamois leather. This cleaning method has the disadvantage that it takes an exceptionally long time and is often not, thorough, so that residual moisture may be left at hard to get at regions of the reels. Nor has the use of Freon baths for cleaning reels proved successful because Freon, which is also a solvent, accumulates in the cavities of the reel and in the case of reels made of plastics material partially dissolves fillers contained therein or, for example, plastics adhesive, resulting in damage to the reels.

German Printed Application (DAS) No. 2,044,828 discloses a method in which the adherence of particles to moving webs, especially plastics webs, due to electrostatic forces is prevented by spraying them with charge carriers, especially ions. For this purpose, discharge means may be provided which produce a corona discharge inside air nozzles by means of a high voltage, and the ions produced in this way are blown by the stream of air onto the surface which is thus freed from electrostatic charges and, at the same time, cleaned.

Since the discharge means disclosed in the abovementioned application is a point electrode ionizer and, as such, can only effect uneven removal of static electrification, it is by no means obvious that it can be used for the reliable cleaning of tape reels.

Besides, tape reels are mass-produced articles, the manufacture of which makes an economic approach imperative.

An object of the present invention is to provide a substantially automatic cleaning device with which reels can be cleaned more reliably, uniformly and economically than by the use of conventional methods.

According to the present invention, a device for cleaning the surfaces of reels, especially magnetic tape reels, comprises means for conveying the reels along a path adjacent to which there are arranged at least two gas nozzles provided with electrical discharge means, at least one jet of charged gas being directed onto each surface of the reel as it is conveyed, and at least one suction device for withdrawing the foreign bodies removed from the reel.

A cleaning device of this type ensures, in a simple way, that dirt and dust particles are removed from the reel and the subsequent adhesion of particles to the reel is prevented by removal of the static electric charges.

In an advantageous embodiment of the invention a nozzle essembly is provided in which the jets of two nozzle groups impinge upon the outer surfaces of the reel, and the jet of at least one single nozzle impinges upon the inner surfaces of the reel flanges and the hub surface.

In a further advantageous embodiment of the invention, suction devices are provided in the vicinity of the swept reel surfaces. In this way, very fast withdrawal of the removed particles is achieved.

In a preferred embodiment of the invention, the reels are rotated about their axes by means of a drive mechanism as they are transported, and the nozzles are arranged at an angle and point in a direction opposing the sense in which the reel rotates.

By arranging the nozzles in this way, the forces which act upon the particles are increased, so that even particles of greater mass can be removed without difficulty.

In a further preferred embodiment of the invention, a group of at least two juxtaposed nozzles is arranged above and below the reel, the distance between the juxtaposed nozzles and the distance between the two groups of nozzles being chosen such that each external reel surface is momentarily swept within the confines of a complete radial strip. This ensures that the reel is completely cleaned after revolving once about its axis.

In practice, the conveying device for the reels to be cleaned conveniently comprise a turntable with a central drive member for the reels and a plurality of spindles on which the reels can be mounted for rotation about their axes.

With such a conveying device it is possible to clean a plurality of reels one after the other automatically, economically and continuously.

The nozzles which direct jets of gas onto the outer surfaces of the reel are advantageously inclined at an angle of 5° to 20°, preferably at an angle of 10°, relative to the axis of rotation of the reel.

An embodiment of the cleaning device according to the present invention will now be explained in further detail by way of example, with reference to the accompanying drawings.

Figure 2:
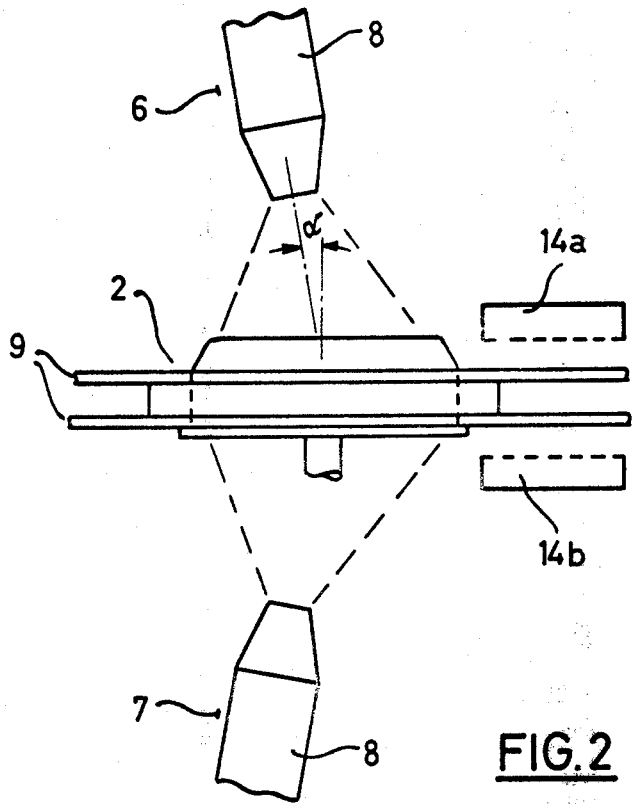
Figure 3:
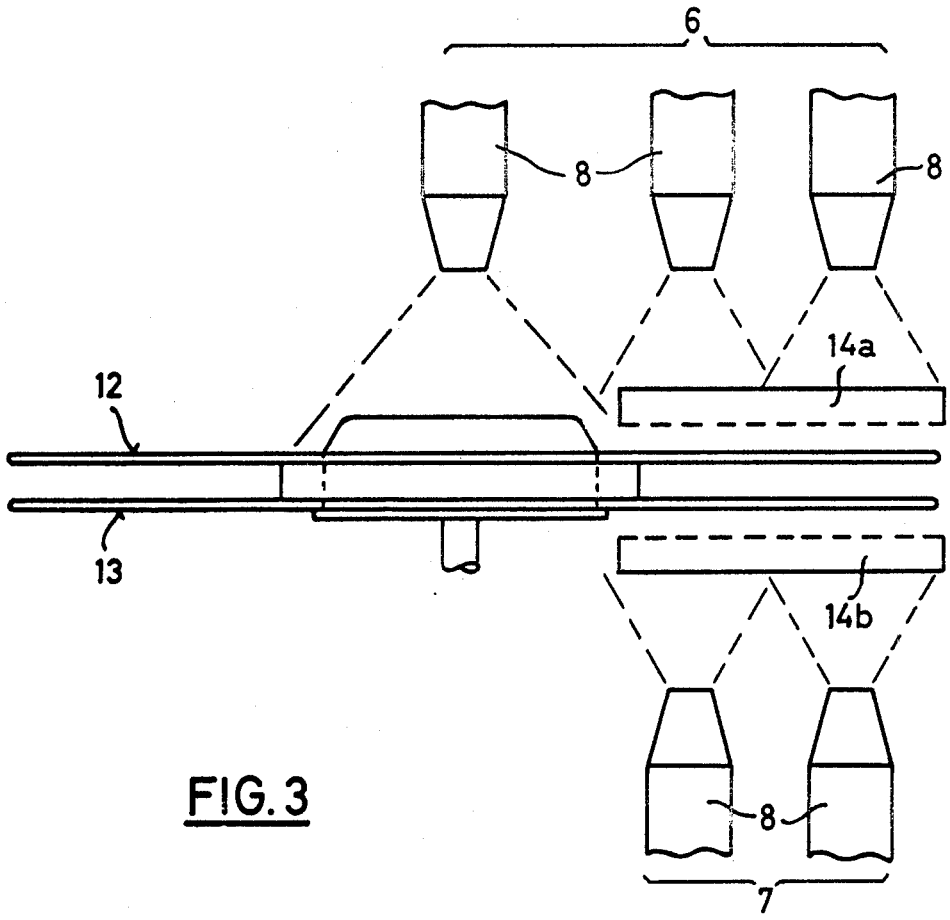
Figure 4:
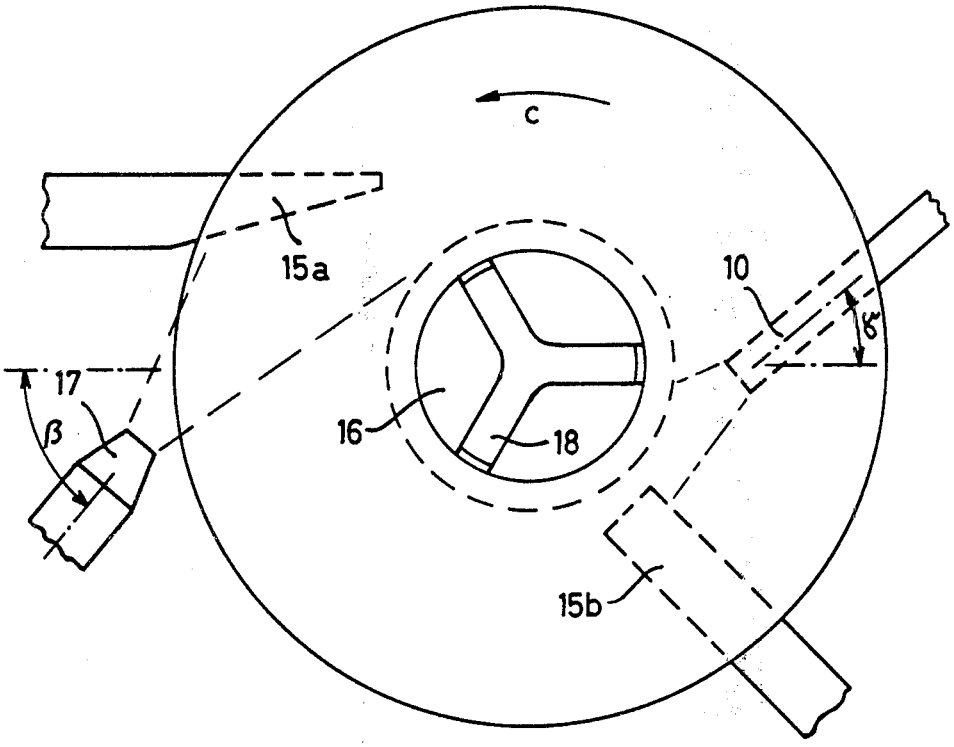

FIG. 1 shows, purely in diagrammatic form, an automatic cleaning device according to the invention, FIG. 2 is an elevation of one reel of the device viewed in the direction A shown in FIG. 1, FIG. 3 is an elevation of the reel of FIG. 2, viewed in the direction B shown in FIG. 1, and FIG. 4 is a plan view of the reel of FIGS. 2 and 3.

The cleaning device 1 for reels 2, shown diagrammatically, comprises conveying means in the form of a turntable 3, driven in the direction of the arrow *a*, six spindles 4 (on which reels 2 can be placed), rotatably mounted on the turntable 3, and a central drive member 5 (rotating in the direction of the arrow *b*) which drives the reels 2 by frictional contact, so that they rotate in the direction of the arrows *c* marked thereon. In FIG. 1, one of the reels 2 happens to be situated between nozzle groups 6 and 7, the upper nozzle group 6 consisting of three individual nozzles 8, and the lower nozzle group 7 of two individual nozzles 8. The individual nozzles 8 of each group are juxtaposed in a substantially radial manner relative to the reel 2. Between the flanges 9 of the reel 2, a further nozzle 10 is located, this nozzle being horizontally disposed. For clarity's sake fastening means and the drive units, etc., have been omitted from the drawings.

The nozzles 8 and 10 comprise electric discharge means, especially means producing ions, which are not shown in the drawings and are connected to means for supplying air or gas under pressure (also not shown).

The electric discharge means operate at a few thousand volts and at low frequency, derived for example from the mains supply (50 hertz). The air or gas pressure can be adjusted in any suitable manner. At the nozzles 8 and 10 the pressure is approximately 2 atmospheres gauge, the velocity of the gas leaving the nozzles in this case being in the region of 10 to 15 meters/-second. FIG. 2 shows a reel 2 in side elevation and the zone swept by the nozzle groups 6 and 7. The nozzle groups 6 and 7 are inclined relative to the rotational axis 11 of the reel 2 at an angle $\alpha$ of 5° to 20°, preferably at an angle of 10°. The direction and shape of the air or gas jets leaving the nozzle groups 6 and 7 are substantially identical, the distance between the nozzle groups and the surfaces 12 and 13 of the reel 2 being a few centimeters, preferably from 6 to 8 cm. Suction devices 14*a* and 14*b* should be located above and below the flanges 9 of the reel for the immediate withdrawal of the foreign bodies removed in the cleaning operation. FIG. 4 shows further suction devices 15*a* and 15*b* positioned between the flanges 9 of a reel. FIG. 3 shows the individual nozzles 8 positioned side by side, the distance between the nozzles 8 in each group being advantageously so chosen that the jets (e.g. conical jets) issuing from them overlap just before impinging upon the reel 2. With this arrangement, the nozzle groups 6 and 7 each cover a radial strip on the reel surfaces, so that, as the reel 2 rotates (the reel dwells within the swept zone for a period approximately equalling the time it takes to rotate eight times about its own axis) all the external surface regions are cleaned and freed from static electric charges before the turntable 3 rotates further. The turntable 3 may rotate continuously at a slow rate (approximately 1 revolution/-min.) or step by step. The dwell time of the reel 2 within the zone swept by nozzle groups 6 and 7 is several seconds, particularly 6 to 8 seconds, so that six reels will have been cleaned after approximately 50 to 60 seconds. The finished reels may be removed from the spindles either mechanically or by hand, and reels which are to be cleaned may be mounted in the same way. FIG. 4 shows a trilobate spindle 18 in a central aperture 16 of a reel 2. As FIG. 4 shows, there may also be provided two jets which are directed between the flanges 9, nozzle 17 being arranged outside the periphery of the flanges and nozzle 10 being situated between the flanges. The distance of the nozzle 17 from the periphery of the flanges 9 and the distance of the nozzle 10 from the hub of the reel may be chosen within a suitable range. The longitudinal axes of nozzles 10 and 17 are at an angle ($\gamma$ and $\beta$) of approximately 40° to 50° to radii of the reel 2, and the direction of the jets should advantageously be opposed to the sense of rotation of the reel.

In practice, the cleaning device will be located in a closed housing, and for economic reasons a central suction device will be preferred to the above-described individual suction devices. Reels made of a variety of different materials have been successfully cleaned in the field with the aid of the cleaning device of the invention and are provided with a more or less effective antistatic finish, depending upon the material of construction used.

What we claim is:

1. A device for cleaning from the surfaces of flanged reels, especially magnetic tape reels, dust and dirt particles, said device comprising:

a means for conveying the reels along a path of gas nozzles in such a position that both outer flange surfaces, both inner flange surfaces and the hub surfaces of said reels are accessible by several jets of cleaning gas leaving said gas nozzles, whereby each gas nozzle is capable of and suitably arranged for directing a jet of gas onto a surface of said reels as they are conveyed and the impacting of said gas on said surface removes said dust and dirt particles therefrom;

said path of gas nozzles comprising at least three groups of gas nozzles, each group consisting of at least one gas nozzle, the first and second groups of gas nozzles being respectively positioned along said path to direct gas onto each of said outer flange surfaces of said reels and the third group being positioned along said path to direct gas onto both of said inner surfaces and the hub of said reels;

a means for ionizing the jets of cleaning gas whereby the static charge on the surfaces of said reels is neutralized so as to enable the easy removal of dust and dirt particles therefrom by said cleaning gas; and a suction device for withdrawing the dust and dirt particles as they are removed from the vicinity of the cleaned surfaces.

2. A device according to claim 1, in which the reels are caused to rotate about their axes by means of a drive mechanism as they are conveyed, and the nozzles are arranged at an angle and point in a direction opposing the sense of reel rotation.

3. A device according to claim 1, in which the nozzles which direct jets of gas onto the outer surfaces of the reel are inclined at an angle of 5° to 20° relative to the rotational axis of the reel.

4. A device according to claim 3, in which said nozzles are inclined at an angle of 10° relative to the rotational axis of the reel.

5. A device according to claim 1, in which the conveying means for the reels to be cleaned comprises a turntable with a central drive member for the reels and a plurality of spindles on which the reels can be mounted for rotation about their axes.

6. A device according to claim 1, in which the nozzles of said first and second groups of gas nozzles are in a juxtaposed position relative to said reels and equidistant from the outer flange surfaces of said reels.

7. A device according to claim 1, in which each of the groups of gas nozzles consists of at least two gas nozzles.

* * * * *